US009401557B2

(12) United States Patent
Lin et al.

(10) Patent No.: US 9,401,557 B2
(45) Date of Patent: Jul. 26, 2016

(54) ELECTRICAL CONNECTOR AND THE ASSEMBLING METHOD THEREOF

(71) Applicant: FOXCONN INTERCONNECT TECHNOLOGY LIMITED, Grand Cayman (KY)

(72) Inventors: Nan-Hung Lin, New Taipei (TW); Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/639,407

(22) Filed: Mar. 5, 2015

(65) Prior Publication Data

US 2015/0255909 A1 Sep. 10, 2015

(30) Foreign Application Priority Data

Mar. 5, 2014 (TW) ..... 103107460 A

(51) Int. Cl.

| | |
|---|---|
| ***H01R 13/40*** | (2006.01) |
| ***H01R 13/405*** | (2006.01) |
| *H01R 43/20* | (2006.01) |
| *H01R 12/70* | (2011.01) |
| *H01R 13/24* | (2006.01) |

(52) U.S. Cl.

CPC ..... *H01R 13/405* (2013.01); *H01R 12/7076* (2013.01); *H01R 13/2442* (2013.01); *H01R 43/20* (2013.01); *Y10T 156/10* (2015.01)

(58) Field of Classification Search

CPC ..... H01R 13/193; H01R 13/41; H01R 13/24; H01R 13/5216

USPC ..... 439/342, 733.1, 736, 936

See application file for complete search history.

(56) References Cited

U.S. PATENT DOCUMENTS

| | | | | | |
|---|---|---|---|---|---|
| 4,083,902 | A * | 4/1978 | Clyde | H01R 13/5216 | 174/76 |
| 4,976,634 | A * | 12/1990 | Green | H01R 13/504 | 439/589 |
| 5,637,007 | A * | 6/1997 | Suzuki | H01R 13/5216 | 439/276 |
| 5,735,697 | A * | 4/1998 | Muzslay | H01R 12/57 | 439/83 |
| 5,941,736 | A * | 8/1999 | Murakami | H01R 13/40 | 439/733.1 |
| 7,537,475 | B2 * | 5/2009 | Wise | H01R 13/62 | 439/276 |
| 7,828,578 | B1 * | 11/2010 | Ju | H01R 13/112 | 439/342 |
| 8,342,873 | B2 * | 1/2013 | Liao | H01R 12/57 | 439/342 |
| 8,430,682 | B2 * | 4/2013 | Liao | H01R 12/57 | 439/342 |
| 8,814,606 | B2 * | 8/2014 | Endo | H01R 13/405 | 439/736 |

* cited by examiner

*Primary Examiner* — Thanh Tam Le

(74) *Attorney, Agent, or Firm* — Wei Te Chung; Ming Chieh Chang

(57) ABSTRACT

An electrical connector (100) includes an insulating housing (1) and a plurality of electrical contacts (2) received therein, the insulating housing (1) includes a top surface (11), a bottom surface (10), a plurality of passageways (110) and a pair of blocks (12) extending toward each other from the inner surface of the passageway (110), each of the electrical contacts (2) includes a body portion (20) positioned in the insulating housing (1), the blocks (12) locate under the body portion (20) of the electrical contact (2), the electrical connector (100) further includes adhesive (3) pasted on the inner surface of the passageway (110), after the electrical contacts (2) are assembled to the insulating housing (1), the electrical contacts (2) touch with the adhesive (3) to position the electrical contacts (2) on the insulating housing (1).

5 Claims, 6 Drawing Sheets

ELECTRICAL CONNECTOR AND THE ASSEMBLING METHOD THEREOF

BACKGROUND OF THE INVENTION

1. Field of the Invention

The present invention relates generally to an electrical connector, and more particularly to an electrical connector using adhesive to position the contacts received therein.

2. Description of Related Art

Normally, the package connects with the substrate through an electrical connector. The electrical connector includes an insulating housing and a plurality of contacts received therein. Each of the contacts includes a body portion positioned on the insulating housing, a top contact portion extending upwardly beyond the insulating housing for connecting with the package and a tail portion extending downwardly beyond the insulating housing for connecting with the substrate. The body portion includes a barb portion interfering with the insulating housing for positioning the contact on the insulating housing. But the barb portion interferes with the insulating housing usually makes the insulating housing be deformed.

Hence, it is desirable to provide an improved electrical connector to overcome the aforementioned disadvantages.

SUMMARY OF THE INVENTION

Accordingly, an object of the present invention is to provide an electrical connector using adhesive to position the contacts in an insulating housing and can prevent the distortion of the insulating housing.

According to one aspect of the present invention, an electrical connector includes an insulating housing and a plurality of electrical contacts received in the insulating housing, the insulating housing has a top surface, a bottom surface opposite to the top surface, a plurality of passageways penetrating the top surface and the bottom surface and a pair of blocks extending toward each other from the inner surface of the passageway, each of the electrical contacts formed with a body portion positioned in the insulating housing, the blocks upwardly support the body portion of the electrical contact, the electrical connector further has adhesive pasted on the inner surface of the passageway, after the electrical contacts are assembled to the insulating housing, the electrical contacts touch with the adhesive and be positioned on the insulating housing by the adhesive.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
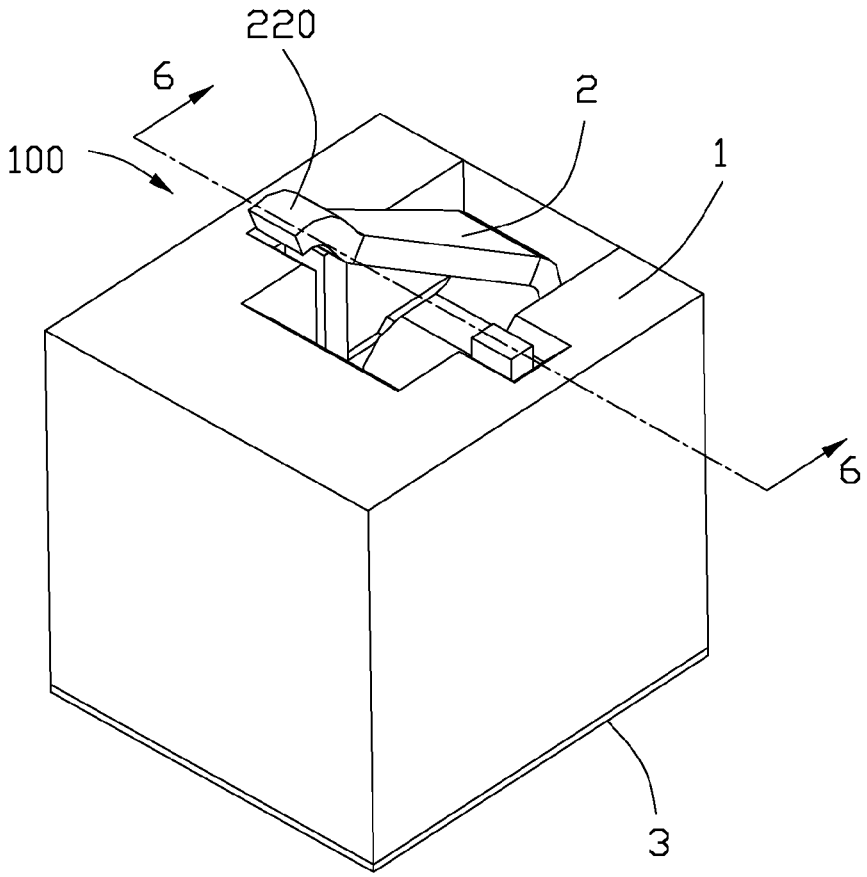
FIG. 1 is an assembled view of a part of an electrical connector according to the present invention.
Figure 5:
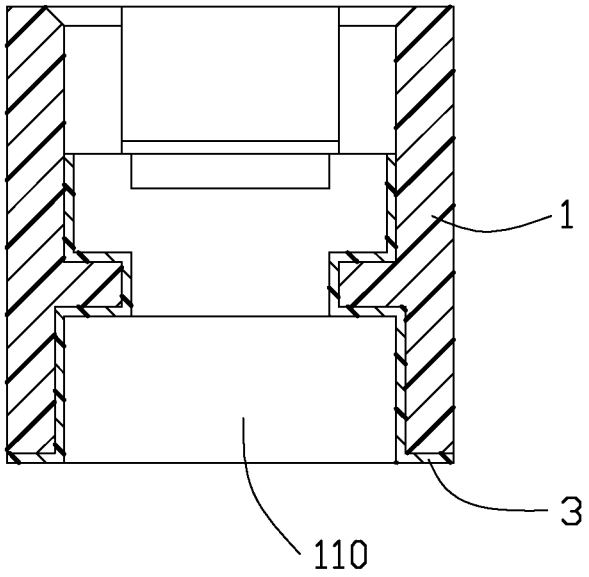
FIG. 5 is similar to FIG. 4, wherein an adhesive is set on the insulating housing.
Figure 6:
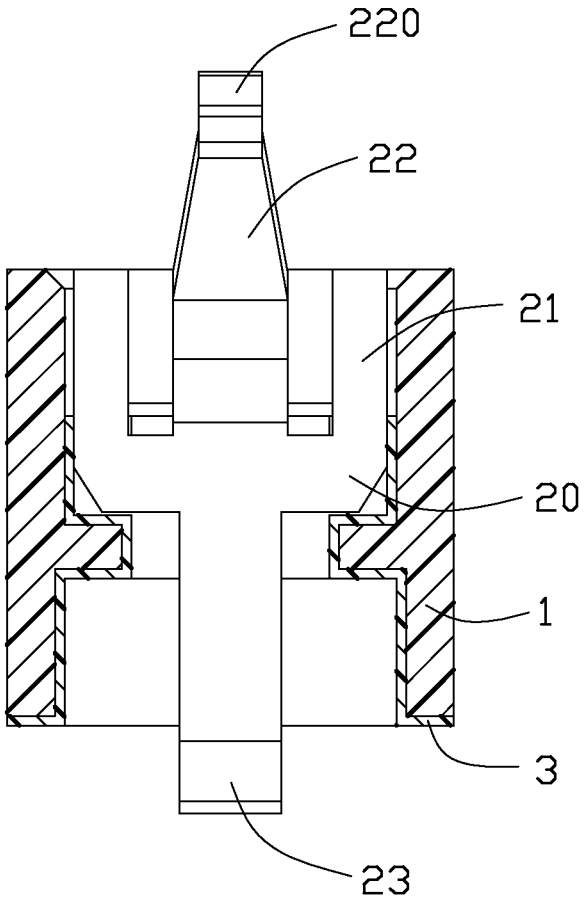
FIG. 6 is a cross-sectional view of the electrical connector along line 6-6 as shown in FIG. 1.

Referring to FIGS. 1 and 5-6, an electrical connector 100 of the present invention includes an insulating housing 1 and a plurality of contacts 2 received in the insulating housing 1. Only one contact 2 and a part of the insulating housing 1 are shown. The electrical connector 100 uses adhesive 3 to position the contacts 2 on the insulating housing 1. When assemble the electrical connector 100, firstly paste the adhesive 3 on the insulating housing 1, and then assemble the electrical contacts 2 to the insulating housing 1, after the adhesive 3 solidifies, the contacts 2 can be positioned on the insulating housing 1 securely. The adhesive 3 can be simple adhesive or UV adhesive. After being shined by UV light, the UV adhesive will solidify quickly.

Figure 2:
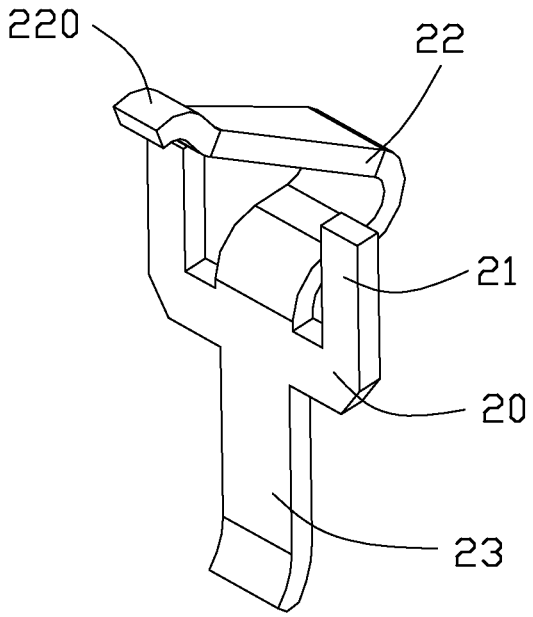
FIG. 2 is an isometric view of a contact of the electrical connector as shown in FIG. 1.

Referring to FIG. 2, each of the electrical contacts 2 includes a body portion 20, a pair of positioning portions 21 extending upwardly from two opposite ends of the body portion 20, a spring portion 22 extending upwardly from the middle of the body portion 20 and a tail portion 23 extending downwardly from the middle of the body portion 20. The spring portion 22 includes a contact portion 220 at the end thereof.

Figure 3:
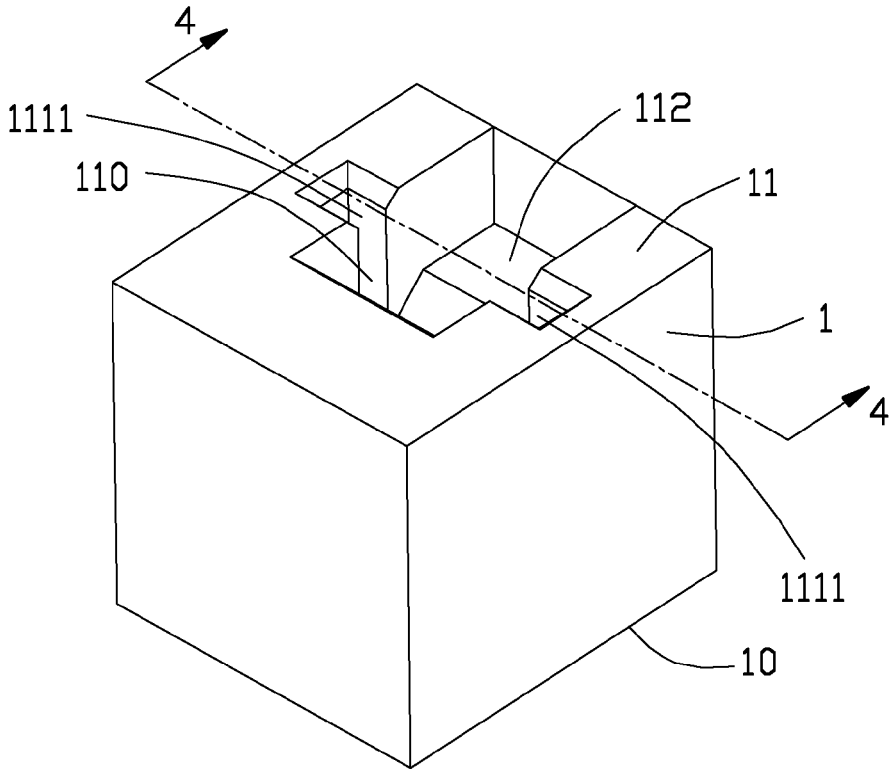
FIG. 3 is an isometric view of a part of the insulating housing as shown in FIG. 1.
Figure 4:
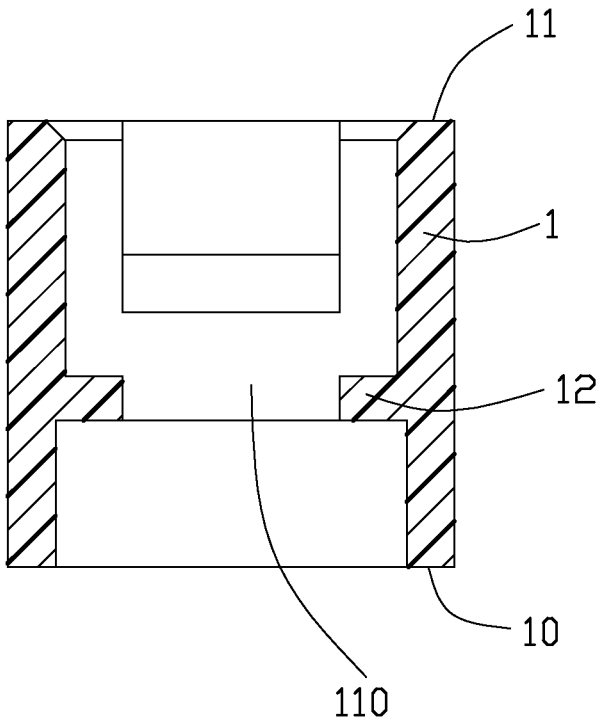
FIG. 4 is a cross-sectional view of the part of the insulating housing along line 4-4 as shown in FIG. 3.

Referring to FIG. 3, the insulating housing 1 includes a top surface 11, a bottom surface 10 opposite to the top surface 11, a plurality of passageways 110 penetrating the top surface 11 and the bottom surface 10 and a plurality of recess 112 recessed from the top surface 11 of the insulating housing 1. Referring to FIG. 1, the spring portion 22 of the electrical contact 2 is received in the recess 112, when exert a force on the spring portion 22, the insulating housing 1 can support the spring portion 22 to prevent the over distortion of the spring portion 22. Referring to FIG. 4, the insulating housing 1 further includes a pair of blocks 12 extending toward each other from the inner surface of the passageway 110. Referring to FIG. 6, after the electrical contacts 2 are assembled to the insulating housing 1, the electrical contacts 2 are supported by the blocks 12 to prevent the electrical contacts 2 breaking away from the bottom side of the insulating housing 1. Notably, in the instant embodiment the passageway 110 includes a pair of slots 1111 to snugly received the corresponding pair of positioning portions 21 therein so as to have the adhesive 3 applied on an interface between the positioning portion 21 and the housing 1 for securing the contact 2 to the housing 1. Understandably, because the adhesive is applied upon an interior surface of the corresponding passageway 110, the opposite surfaces of the positioning portion 21 and the side edge thereof are clued by the adhesive 3.

Referring to FIGS. 4-6, the method for assembling the electrical connector 100 is as following: firstly, dip the insulating housing 1 in the adhesive 3 to make the inner surface of the passageway 110 to be pasted with the adhesive 3; secondly, assemble the electrical contacts 2 into the passageways 110 of the insulating housing 1 from the top surface 11 of the insulating housing 1 and to make electrical contacts 2 touch with the adhesive 3; and then solidify the adhesive 3 to make the electrical contacts 2 be positioned on the insulating housing 1 securely.

The electrical connector 100 uses adhesive 3 to position the electrical contacts 2 on the insulating housing 1, the electrical contacts 2 do not interference with the insulating housing 1, which can prevent the distortion of the insulating housing 1.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector, comprising:

an insulating housing having a top surface, a bottom surface opposite to the top surface and a plurality of passageways penetrating the top surface and the bottom surface; and a plurality of electrical contacts received in the insulating housing, each of the electrical contacts formed with a horizontally extending body portion positioned in the insulating housing; wherein the insulating housing further has a pair of blocks extending toward each other from the inner surface of the passageway, the blocks upwardly support the body portion of the electrical contact; and the electrical connector further includes adhesive pasted on the inner surface of the passageway, after the electrical contacts are assembled to the insulating housing, the electrical contacts touch with the adhesive and be positioned on the insulating housing by the adhesive; wherein the insulating housing has a plurality of recesses recessed from the top surface of the insulating housing communicating with the corresponding passageways respectively, and the electrical contact includes a spring portion extending upwardly from a middle area of the body portion and received in the recess, and a tail portion downwardly extending from the middle area of the body portion in an outwardly curved configuration away from a plane defined by the body portion; wherein the electrical contact further has a pair of positioning portions extending upwardly from two opposite ends of the body portion and located by two sides of the corresponding spring portion, respectively; wherein each of said passageways includes a pair of slots located by two sides of the corresponding recess to snugly receive the corresponding pair of positioning portions, respectively; wherein said adhesive is applied on interior surfaces of each of said slot to secure the corresponding portion; and wherein the adhesive extends upwardly from the bottom surface of the housing, and is terminated at a middle level of the slot.

2. The electrical connector as claimed in claim 1, wherein the adhesive is UV adhesive, and can be solidify quickly by being shined by UV light.

3. A method for assembling an electrical connector, comprising:

provide an insulating housing, the insulating housing having a top surface, a bottom surface opposite to the top surface, a plurality of passageways penetrating the top surface and the bottom surface and a pair of blocks extending toward each other from the inner surface of the passageway;

dip the insulating housing downwardly into an adhesive to make an inner surface of the passageway to be pasted with the adhesive;

provide an electrical contact, the electrical contact having a body portion, assemble the electrical contact into the passageway of the insulating housing from the top surface of the insulating housing and make electrical contact touch with the adhesive, the blocks locating under the body portion of the electrical contact; and solidify the adhesive to make the electrical contacts be positioned on the insulating housing; wherein the insulating housing has a plurality of recesses recessed from the top surface of the insulating housing communicating with the corresponding passageways, respectively, and the electrical contact includes a spring portion extending upwardly from a middle area of the body portion and received in the recess, and a tail portion downwardly extending from the middle area of the body portion in an outwardly curved configuration away from a plane defined by the body portion; wherein the electrical contact further has a pair of positioning portions extending upwardly from two opposite ends of the body portion and located by two sides of the corresponding spring portion, respectively; wherein each of said passageways includes a pair of slots located by two sides of the corresponding recess to snugly receive the corresponding pair of positioning portions, respectively; wherein said adhesive is applied on interior surfaces of each of said slot to secure the corresponding portion; and wherein the adhesive extends upwardly from the bottom surface of the housing, and is terminated at a middle level of the slot.

4. The method for assembling an electrical connector as claimed in claim 3, wherein the adhesive is UV adhesive, after being shined UV light, the UV adhesive will be solidify quickly.

5. An electrical connector comprising:

an insulative housing forming a plurality of passageways;

a plurality of conductive contacts disposed within the corresponding passageways, respectively;

each of said contacts having a horizontally extending body portion with a pair of positioning portions extending upwardly from a middle area of the body portion and located at two opposite ends of said body portion, respectively, to abut against the housing to form an interface therebetween; and said interface being equipped with an adhesive layer so as to secure the contact within the corresponding passageway without deforming the housing; wherein each of said contacts is formed by sheet metal, and each of said positioning portions is essentially of a ,plate configuration with the corresponding adhesive layer applied upon at least two opposite surfaces thereof; wherein said adhesive layer is further applied to a corresponding side edge of the positioning portion; wherein each of said passageways includes a pair of slots to respectively snugly receive the pair of positioning portions of the corresponding contact; wherein each of said passageways is further equipped with a block to upwardly support a step structure of the corresponding contacts so as to prevent downward movement of the contact; wherein said block is formed under the positioning portion; wherein the housing further includes a plurality of recesses communicating with the corresponding passageways, respectively, and the pair of corresponding slots are located by two sides of the recess, respectively; wherein each of said contacts further includes a spring portion upwardly extending from a middle area of the corresponding body portion and received within the corresponding recess, and a tail portion downwardly extending from the middle area of the body portion in an outwardly curved manner away from a plane defined by the body portion; and wherein the adhesive extends upwardly from the bottom surface of the housing, and is terminated at a middle level of the slot.

* * * * *